US006481818B1

(12) United States Patent
Cox et al.

(10) Patent No.: US 6,481,818 B1
(45) Date of Patent: Nov. 19, 2002

(54) METHOD AND FACILITY FOR PREVENTING OVERHEATING OF A THERMAL INK JET PRINT HEAD

(75) Inventors: Roger T. Cox, Vancouver, WA (US); William S. Osborne, Camas, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/638,225

(22) Filed: Aug. 14, 2000

(51) Int. Cl.[7] ..... B41I 29/38
(52) U.S. Cl. ..... 347/14
(58) Field of Search ..... 347/14, 9, 15, 347/37, 40–41, 43, 12–13, 16; 400/279, 322, 323; 358/502–503, 1.8, 455, 458

(56) References Cited

U.S. PATENT DOCUMENTS 5,617,122 A 4/1997 Numata et al.
5,644,683 A 7/1997 Ross et al.

FOREIGN PATENT DOCUMENTS

| | | |
|---|---|---|
| EP | 0 925 938 A2 | 6/1991 |
| EP | 0 720 917 A2 | 1/1996 |
| FR | 2 744 061 | 8/1997 |

OTHER PUBLICATIONS

UK Search Report; Oct. 17, 2001; 2 pp.; re related UK patent application No. GB 0118893.7.

*Primary Examiner*—John Barlow
*Assistant Examiner*—K. Feggins

(57) ABSTRACT

A method of printing includes receiving print data for a swath to be printed. The swath has a matrix of pixels arranged in rows and columns. For a succession of adjacent row segments of the swath, a cumulative total of pixels to be printed is calculated. If the cumulative total exceeds a preselected threshold upon inclusion of row segment, printing is limited to a limited subset of row segments of the swath.

10 Claims, 5 Drawing Sheets

METHOD AND FACILITY FOR PREVENTING OVERHEATING OF A THERMAL INK JET PRINT HEAD

BACKGROUND

This invention relates to ink jet printing, and more particularly to techniques for preventing overheating.

BACKGROUND AND SUMMARY OF THE INVENTION

Thermal ink jet printing normally seeks to offer high print quality and fast printing speeds. While these often face tradeoffs, with a reduction in one factor permitting an improvement on the other, development efforts seek ways to improve both, or at least to improve one without significant compromise to the other.

Print quality is often improved by increasing printing resolution, so that more printed dots per inch (DPI) are generated for a more detailed image. However, increasing the resolution means not only decreasing the spacing of nozzles on an ink jet print head orifice plate, but increasing the frequency at which the nozzles are actuated as the print head scans over a media sheet to generate a printed swath. While effective in some printing conditions, it has been found that high density printing at high frequencies causes print head overheating. This may render the printed output unusable, as the pen may cease to function. In severe cases, the pen may be damaged permanently.

To avoid overheating, printing frequency may be limited, either by limiting resolution along the scan direction (sacrificing print quality) or by limiting scan velocity (sacrificing speed). Another measure is to pause printing occasionally, such as at the end of each scan, allowing the print head to dissipate an adequate amount of heat energy accumulated during high frequency printing. This suffers the disadvantage that print quality may be sacrificed, as some printing modes and ink types require a "wet edge" of a prior printed swath as the next swath is laid down, to avoid visible knit lines at junctions between swaths. Another disadvantage is the time delay caused by the pausing, which reduces overall printing speed. Even if these were tolerable, pausing after each swath is unsuitable for larger format printers, which may be overheated even during a single swath. As printers are operated at higher resolutions and speeds, the issue of overheating on a single swath may arise even in smaller format printers.

Large format printers have addressed the issue of overheating during a single swath of high density printing by printing in an interlaced manner. That is, a swath is laid down in several passes, with only an integral fraction of the nozzles being used for each pass. For instance, the odd nozzles are used on the first pass, with the evens on the second to form the full swath. A three-pass mode uses every third nozzle on the first pass, then the set of nozzles offset by one from the first set on the second pass, then the remaining nozzles on the third pass. Another method is to create a checkerboard pattern and reduce the firing frequency of individual nozzles and still use the same number of nozzles to create each pass.

To avoid needless speed reduction while printing less dense portions of the printout, the printer may switch between interlaced mode and normal mode. This has the disadvantage of impairing print uniformity, as each mode may have a slightly different appearance. Also, the transitions between print modes may be complex, as printing often occurs with overlapping or shingled techniques that do not easily transition without complex software algorithms. In addition, the electronics required to store and analyze a page of print data to determine which modes are suited to which portions requires costly memory resources on the printer or connected computer, and the processing time also reduces printing speed. The transition in and out of these slower printmodes also has a speed penalty at the transition, extra sweeps may be required to complete one block and then start the next. Depending on the data content this can be severe.

A further disadvantage of the interlaced technique is that it provides compensation in often excessively large increments. This means that a slight density excess will lead to a speed penalty by a factor of two. Any density levels above 2.0 require a speed penalty by a factor of three, etc.

SUMMARY

The present invention overcomes the limitations of the prior art by providing a printer and method of printing. The method includes receiving print data for a swath to be printed. The swath has a matrix of pixels arranged in rows and columns. For a succession of adjacent row segments of the swath, a cumulative total of pixels to be printed is calculated. If the cumulative total exceeds a preselected threshold upon inclusion of row segment, printing is limited to a limited subset of row segments of the swath.

DETAILED DESCRIPTION OF A PREFERRED EMBODIMENT

Figure 1:
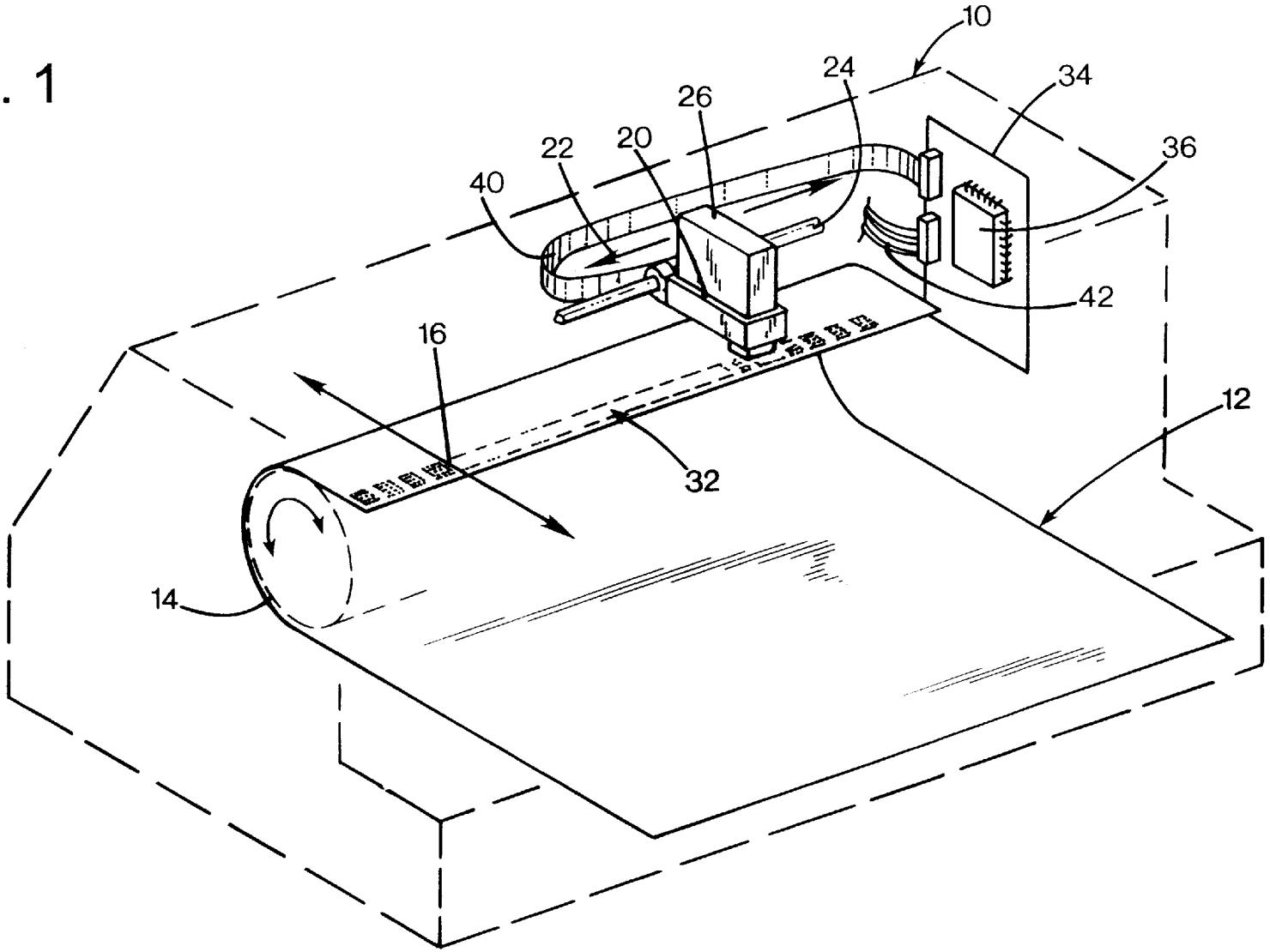
FIG. 1 is a simplified view of a printer according to the preferred embodiment of the invention.

FIG. 1 shows an ink jet printer 10 into which a sheet of printer media 12 has been loaded. The printer has a media drive mechanism 14 that feeds the sheet along a paper path, with motion of the sheet defining a feed axis 16. A print head carriage 20 reciprocates along a scan axis 22 on a guide rod 24, and carries a print cartridge 26 that expels ink droplets onto the media surface to generate a printed swath- 32. A circuit board 34 supports a processor 36 including memory storage space. A multi-line flexible connector 40 connects the circuit board to the carriage, and thereby to the pen, and an input line 42 connects to a computer, network, or other device (not shown) that transmits print data to the printer for printing.

Figure 2:
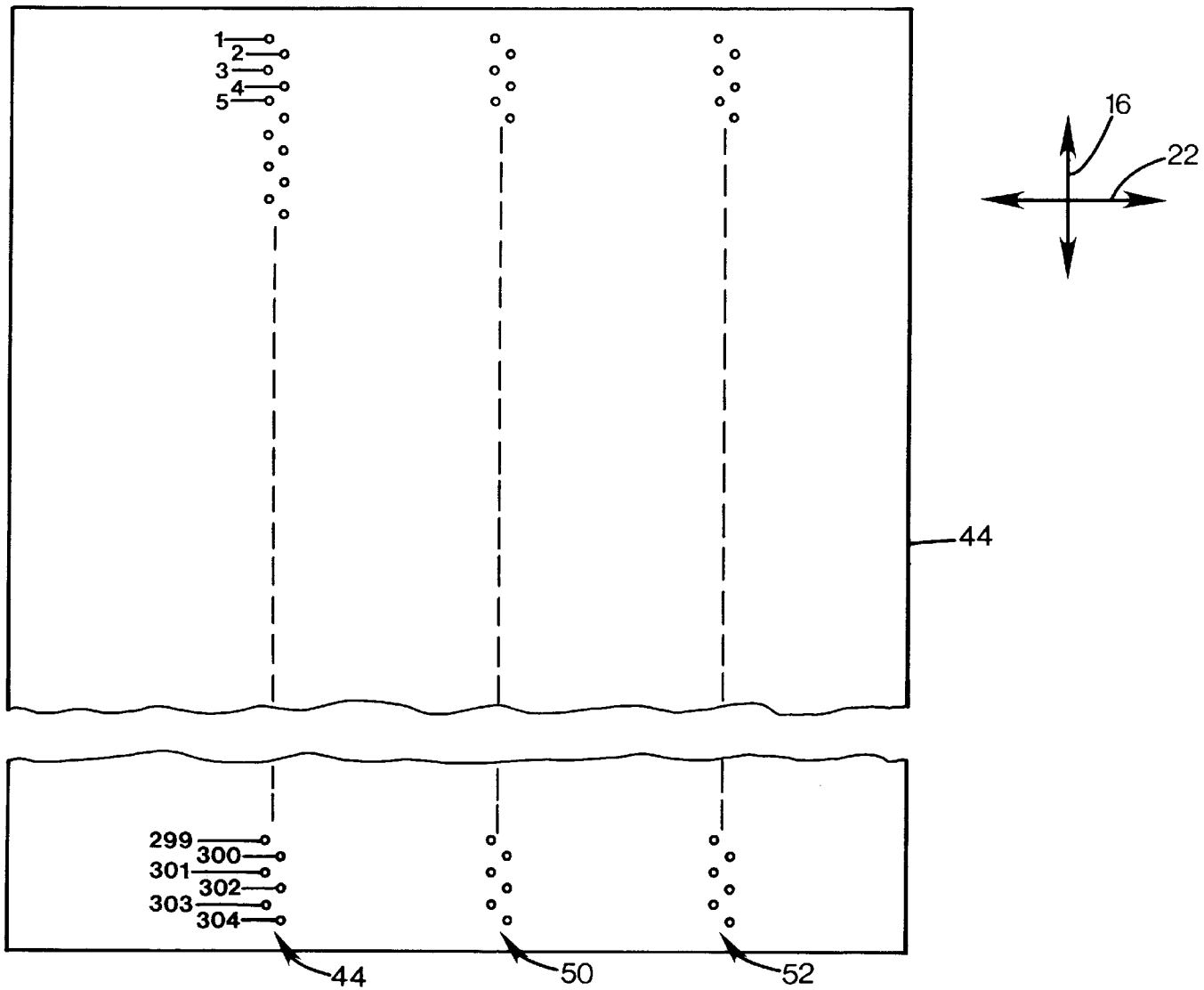
FIG. 2 shows an ink jet print head according to the embodiment of FIG. 1.

FIG. 2 shows a print head 44 in reflected view, or as viewed from above from within the pen, looking toward the media to be printed. The print head 44 has a linear array 46 of nozzles (indicated with numbers 1–304.) The array runs parallel to the scan axis 16, and the nozzles are evenly spaced apart along the scan direction. Each nozzle is considered to be functionally adjacent to its numerical neighbors, although the nozzles may be arranged in alternating fashion to provide higher resolution printing. Functionally, for purposes of illustrating the preferred embodiment, the nozzles may be considered to be in a straight line in sequential arrangement. In the preferred embodiment, 304 nozzles are provided, although any number may be used. The array 46 is connected to a supply of one ink color, and arrays 50, 52 are provided to print other ink colors, permitting three color ink printing. In alternative embodiments, different numbers of arrays may be provided, including a single array for a monochromatic pen.

Figure 3:
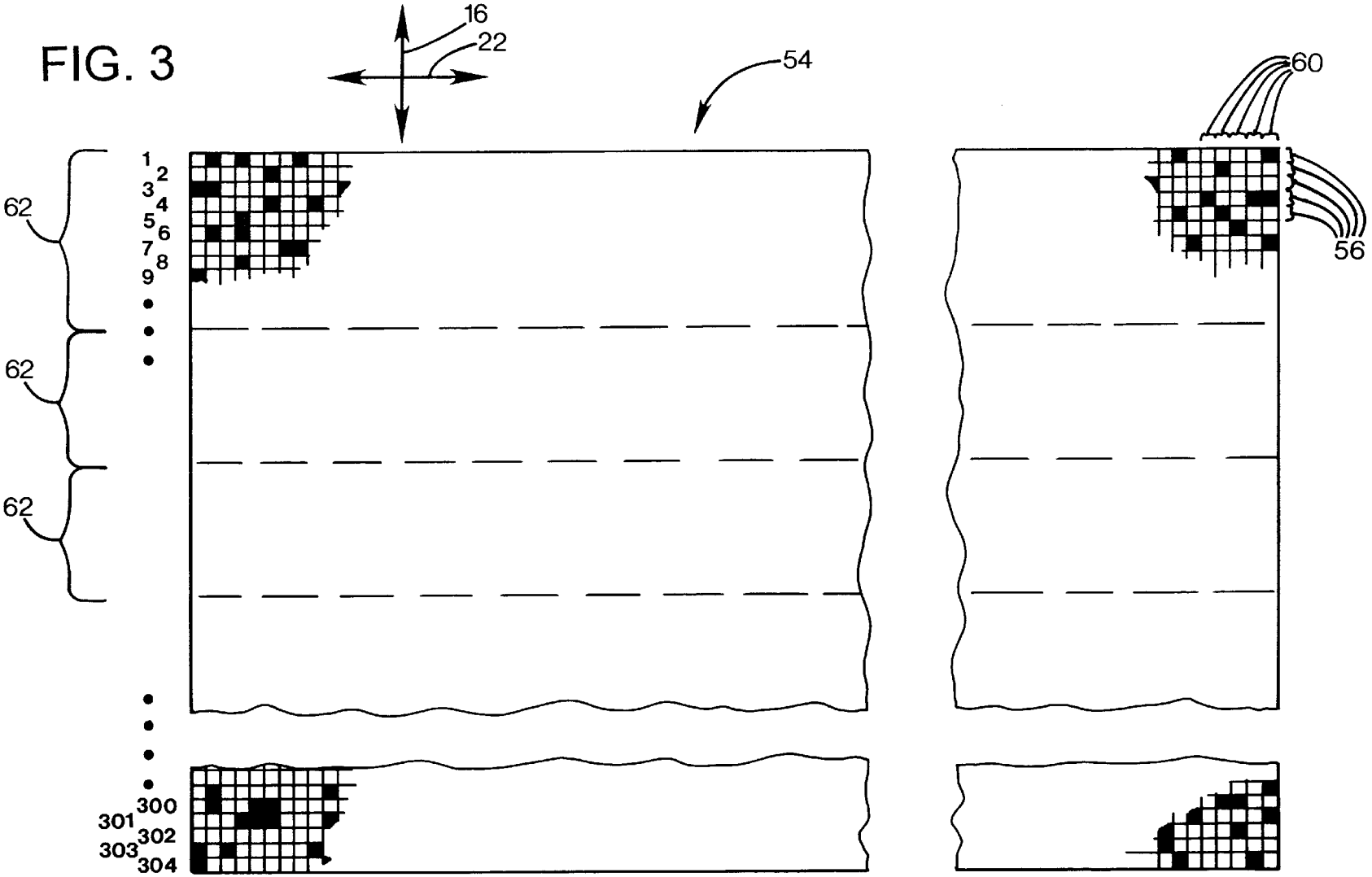
FIG. 3 shows a printout according to the embodiment of FIG. 1.

FIG. 3 shows a matrix 54 representing print data for a swath to be printed, and also represents the printout of that data. The swath is arranged in a matrix of rows 56 and columns 60. Each row corresponds to nozzle of a given array, so that there are 304 rows per swath in the preferred embodiment, with the rows being identified to correspond to the nozzles. In alternative embodiments, the swath may have slightly fewer rows than nozzles, so that edge allowance is provided for various alignment techniques. The number of columns depends on page width (i.e. swath length) and resolution. For a 600 DPI printer with an 8-inch long swath, 4800 columns are provided. Thus, the swath matrix has 1,459,200 position elements or pixels. Each position may either receive an ink drop or remain unprinted. In the print data, the value of each matrix position is assigned a binary value indicating whether or not the position is to be printed.

The print data is divided into row segments 62, each including 16 rows of data. In alternative embodiments, the segments may be any size, as small as one row of data. Preferably there are at least 5 segments in the matrix, and most preferably about 20, as shown. A higher number of segments allows a more optimal operation near the limit of density, to minimize needless speed sacrifices.

Figure 4:
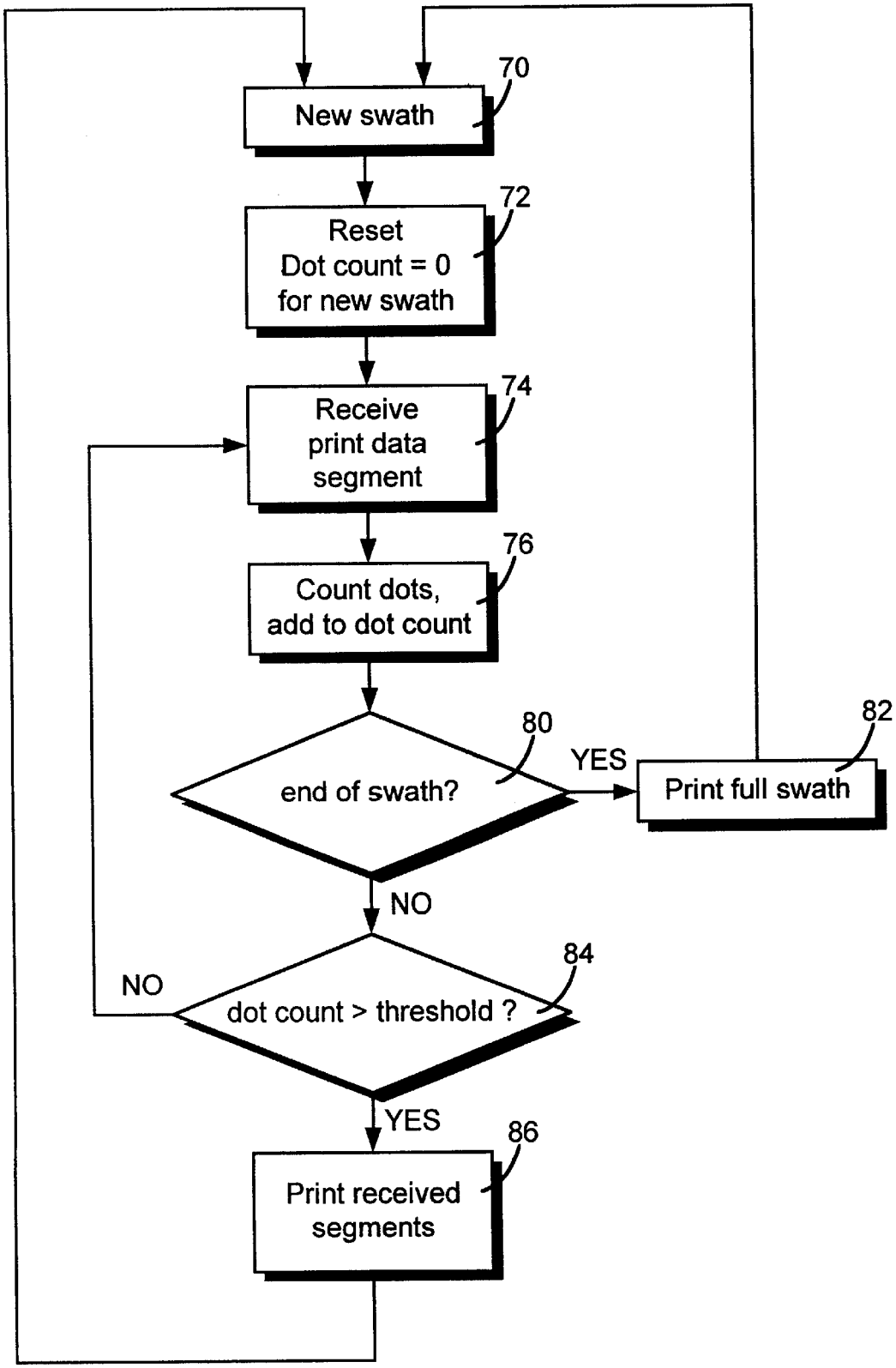
FIG. 4 is a flow chart according to a preferred embodiment of the invention.

FIG. 4 shows a flow chart illustrating the printing process. A new swath is started in step 70, a dot counter is set to zero in step 72, and receipt of print data for the swath begins in step 74. Print data is received in segments corresponding to segments 62 in FIG. 3, and may similarly be of a wide range of sizes, including single rows. As each segment is received, and stored in a buffer, the number of dots to be printed in the segment is determined, and added to the dot count value in step 76. In step 80, it is determined whether the print data for the swath is complete, that is, whether the segment is the last of the print segments for the swath. If so, the buffer sends the print data to the print head and the full swath is printed in step 82, and the process cycles back to step 70 for the next swath.

If the end of the swath data has not yet been reached, the printer determines in step 84 whether the dot count has exceeded a selected threshold representing a maximum tolerable number of dots per swath to avoid overheating effects. If the threshold has not yet been reached or exceeded, the process returns to step 74, where the next segment of the swath data is received. For each segment, step 80 determines whether it is the last segment, and if not, whether the segment contains the dots that put the total dot count over the allowed threshold.

In a high density printing circumstance, one of the segments will cause the threshold to be exceeded. In the preferred embodiment, the dot threshold is set below the absolute limit by the maximum number of dots in a segment so that there is a margin of safety that permits the exceeding segment to be printed. This avoids having to set aside the last segment for printing as part of the next swath, and permits the scenario in which the final segment contains excess dots, but where printing of the full swath is permitted in step 80, even before a final dot count. In an alternative embodiment using the actual limit value for the threshold, step 84 would immediately follow step 76, and the end of swath query step 80 would occur immediately following the "No" path from step 84.

If the final segment triggers an excess dot count determination, then only the segments received up to that point are printed in step 86, after which the process returns to step 70, so that the next data is the first of the next swath. In the alternative embodiment discussed above in which the threshold is set without a margin of safety, all but the final segment would be printed, and the data from the final segment (that caused the excess dot count) would be the first segment of the next swath.

Figure 5:
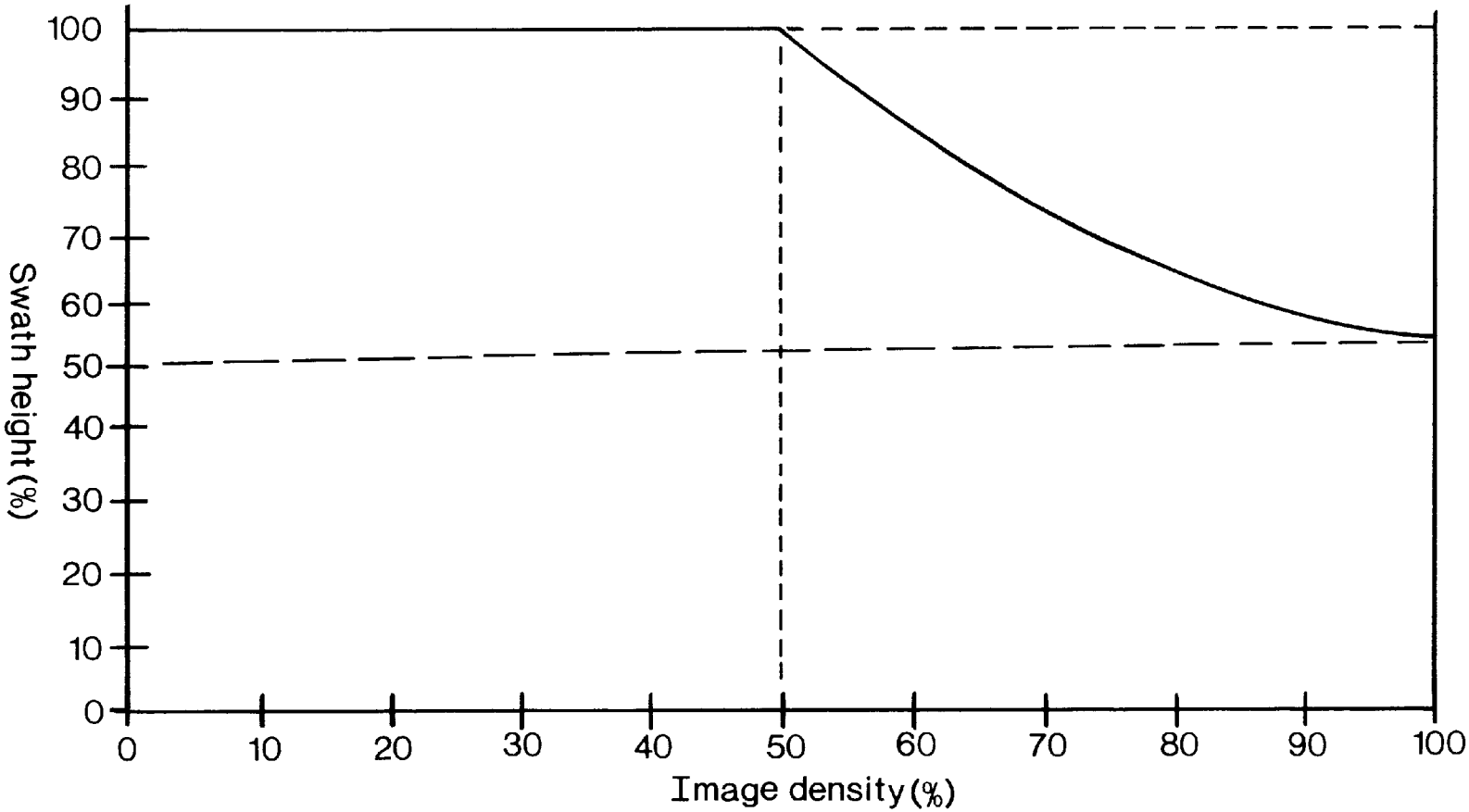
FIG. 5 is a graph of swath height printed as a function of density.

FIG. 5 shows a graph illustrating the results of application of the above technique. The graph shows how swath height is a function of image density, remaining at 100% up to a first threshold, in this case 50% density, where half of all pixels are printed. Above this threshold, the number of dots per swath may not increase, so the swath height is decreased on a downward curve that is concave upward. The curve portion reflects that the product of density and height is a constant at the limits of printing capability, so that density and height are inversely related.

The analysis process may alternatively proceed not as a dot count, but as an examination of swaths or swath segments for density (percentage of pixels printed), and applying the illustrated function.

For color printing, each color may be treated separately, and all colors printed on a scan pass having swath heights limited based on the color with the highest density or dot count requiring the limitation.

While the above is discussed in terms of preferred and alternative embodiments, the invention is not intended to be so limited.

What is claimed is:

1. A method of printing information in swaths, wherein a swath height is defined by adjacent rows of pixels in which dots may be printed, the number of dots printed in a given number of pixel rows representing a print density, the method comprising the steps of:

dividing the pixel rows of the swath height into adjacent segments, each segment comprising a given number of pixel rows;

processing print data corresponding to the swath by successively determining for each segment the print density of that segment as well as the cumulative total of the print density of that segment and the preceding segments of the swath; and, once the cumulative total exceeds a predetermined level;

printing a portion of the swath height comprising the row segments for which the cumulative total of the print density exceeds the predetermined level.

2. The method of claim 1 including the step of establishing a threshold print density so that the entire height of any swath having a print density greater than We threshold print density will not be printed at one time,, and wherein the predetermined level represents the maximum number of the swath segments that can be printed without exceeding the threshold print density.

3. The method of claim 1 including the step of establishing a threshold print density such tat the entire height of any swath having a print density greater than the threshold print density will not be entirely printed at one time, and wherein the predetermined level represents one segment less than the maximum number of the swath segments that can be printed without exceeding the threshold print density.

4. The method of claim 1 wherein the given number of pixel rows of the segment is a single one of the pixel rows that define the swath height.

5. The method of claim 1 wherein the given number of pixel rows of the segment is a fraction of the number of pixel rows that define the swath height.

6. In a printing operation wherein a swath of information may be printed as a group of adjacent segments, each segment comprising rows of pixels within which dots may be printed, wherein a print density corresponds to the amount of dots printed in the segments, a method of controlling the printing operation to prevent printing a swath having a swath print density that is greater than a predetermined swath print density limit, the method comprising the steps of:

calculating the greatest number of adjacent segments of the swath that can be printed such that the sum of the print density of those segments does not exceed the swath print density limit; and printing that greatest number of adjacent segments of the swath.

7. The method of claim 6 wherein the calculating step includes sequentially examining print data segment by segment for each segment of the group of swath segments.

8. The method of claim 7 wherein the calculating step is suspended and the printing step is commenced once the greatest number of adjacent segments has been calculated.

9. The method of claim 6 wherein the number of rows in a segment is predetermined prior to the calculating step.

10. The method of claim 6 including the step of printing the entire swath in instances where the calculated greatest number of adjacent segments of the swath that can be printed is the same as the number of segments in the swat.

* * * * *

UNITED STATES PATENT AND TRADEMARK OFFICE

CERTIFICATE OF CORRECTION

PATENT NO. : 6,481,818 B1
DATED : November 19, 2002
INVENTOR(S) : Cox et al.

It is certified that error appears in the above-identified patent and that said Letters Patent is hereby corrected as shown below:

Column 4,
Line 50, “We” should read -- the --;
Line 56, “tat” should read -- that --;

Column 6,
Line 13, “swat” should read -- swath --.

Signed and Sealed this

Fourth Day of March, 2003

JAMES E. ROGAN
*Director of the United States Patent and Trademark Office*